US007114963B2

(12) United States Patent
Shuey et al.

(10) Patent No.: US 7,114,963 B2
(45) Date of Patent: Oct. 3, 2006

(54) MODULAR HIGH SPEED CONNECTOR ASSEMBLY

(75) Inventors: Scott Anthony Shuey, Harrisburg, PA (US); Eric David Briant, Harrisburg, PA (US); Douglas Wade Glover, Dauphin, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/043,846

(22) Filed: Jan. 26, 2005

(65) Prior Publication Data

US 2006/0166560 A1 Jul. 27, 2006

(51) Int. Cl.
*H01R 12/00* (2006.01)

(52) U.S. Cl. ..... 439/79; 439/660

(58) Field of Classification Search ..... 439/79, 439/78, 74, 608, 660, 636, 60
See application file for complete search history.

(56) References Cited

U.S. PATENT DOCUMENTS 5,098,311 A * 3/1992 Roath et al. ..... 439/295
6,042,386 A * 3/2000 Cohen et al. ..... 439/60
6,231,355 B1 * 5/2001 Trammel et al. ..... 439/79
6,290,547 B1 9/2001 David et al. ..... 439/701
6,315,615 B1 11/2001 Raistrick ..... 439/637
6,363,607 B1 * 4/2002 Chen et al. ..... 29/883
6,419,502 B1 * 7/2002 Trammel ..... 439/79

OTHER PUBLICATIONS

Tyco Electronics, AMP Champ* .050 Series 1 Blindmate Plug and Receptacle Single Connector Attachment (SCA-2), Application Specification 114-6061, Sep. 14, 2000, pp. 1-14, Revision C, Tyco Electronics Corporation, Harrisburg, Pennsylvania, USA.
AMP Incorporated, Harrisburg, PA, Drawing No. C-788389 dated May 19, 1998.

* cited by examiner

*Primary Examiner*—Michael C. Zarroli

(57) ABSTRACT

An electrical connector is provided that comprises a contact having a straight body portion defining, and extending along, a linear axis. The body portion has one end formed integral with a contact tail that is configured to be joined to a circuit board. The body portion has an opposed end formed integral with a curved engagement end configured to engage a mating connector. The connector further includes an outer shell and a contact retention module. The outer shell has a mating end configured to be joined with a mating connector and has a board-engaging end configured to be joined to a circuit board. The outer shell has an interior cavity opening onto the mating end and an open socket facing the board-engaging end. The contact retention module is over molded about the straight body portion of the contact. The contact retention module is held within the open socket of the outer shell with the curved engagement portion extending beyond the contact retention module into the cavity.

17 Claims, 7 Drawing Sheets

MODULAR HIGH SPEED CONNECTOR ASSEMBLY

BACKGROUND OF THE INVENTION

The present invention generally relates to an electrical connector assembly, and more particularly to a high speed modular connector configuration.

A wide variety of connectors have been proposed for various applications, one example of which is the single connector attachment (SCA) type plug and receptacle connector. SCA series 1 (SCA-1) and SCA series 2 (SCA-2) connectors are used today. The SCA-2 connectors are available in 20, 40 and 80 pin position configurations and contain through-hole contacts or compliant pin contacts arranged on a predetermined centerline spacing. The SCA-2 connector plugs are available in vertical and straddle mount, while the SCA-2 connector receptacles are available in right-angle, vertical, press-fit vertical, extended height press-fit vertical and extended height vertical arrangements. These SCA-2 connectors are compatible with SCA-1 board-to-board connectors.

However, conventional SCA connectors have met with certain limitations. As data transmission speeds increase, the conventional SCA connectors are unable to maintain a desired signal-to-noise ratio (SNR) and experience undue increases in interference such as in crosstalk. Today, conventional SCA-2 connectors support transmission speeds of up to 4.25 Gigabits per second. As the transmission speed increases above 4.25 Gbits/sec, the SNR decreases and crosstalk increases to levels that significantly degrade the signal quality.

Conventional SCA-2 connectors retain the contacts within an insulated housing of the connector utilizing a "stitched design". In a stitched design, the insulated housing is formed first with an arrangement of passages through the housing. Contacts are then inserted through the passages into the housing. The stitched design creates an uneven surface environment surrounding each contact as the housing touches the contact at certain points and does not touch the contact at other points, thereby exposing regions of the contact surface to air. The uneven surface environment undesirably impacts the impedance characteristics of the contact, particularly at high data rates.

Further, conventional SCA-2 connectors utilize contacts that include multiple curves and bends along the length of the contact. The curves and bends undesirably impact the signal characteristics of the contact, particularly at high data rates.

A need remains for an improved receptacle connector that is configured to be backward compatible with conventional SCA-2 connector plugs, yet is able to carry data at transmission speeds higher than 4.25 Gigabits/sec and up to at least 8.5 Gigabits/sec.

BRIEF DESCRIPTION OF THE INVENTION

An electrical connector is provided in accordance with an embodiment of the present invention. The connector includes a contact, an outer shell and a contact retention module. The contact has a straight body portion defining, and extending along, a linear axis. The body portion has one end formed integral with a contact tail that is configured to be joined to a circuit board. The body portion has an opposed end formed integral with a curved engagement portion configured to engage a mating connector. The outer shell has a mating end configured to be joined with a mating connector and has a board-engaging end configured to be joined to a circuit board. The outer shell has an interior cavity opening onto the mating end and an open socket facing the board-engaging end. The contact retention module is over molded at least about the straight body portion of the contact. The contact retention module is held within the open socket of the outer shell with the curved engagement portion extending beyond the contact retention module into the cavity.

Optionally, the contact retention module may be over molded about multiple contacts arranged in a row along a length of the contact retention module. Alternatively, a pair of contact retention modules may be arranged parallel to, and abutted against, one another within the socket of the outer shell. The pair of contact retention modules retain corresponding contacts in an arrangement opposite to, and facing, one another in the cavity. The curved engagement portions of the contacts in each contact pair are offset from one another in a make-first-break-last arrangement. The body portions of opposed contacts within each pair of contacts may extend toward one another, within the corresponding contact retention modules, in a V-shaped manner.

The body portion of each contact may have first and second sections with different widths, wherein the first section is over molded or otherwise evenly and uniformly embedded within the contact retention module while the second section projects from the contact retention module, and is evenly and uniformly surrounded by air in the cavity of the outer shell. Optionally, the width of the second section may be greater than the width of the first section to maintain consistent impedance characteristics for signals traveling through the body portion. The body portion may have a transition area with a tapered width proximate a face of the contact retention module between wherein the taper expands between the first and second sections as the body portion progresses from the contact retention module into the interior cavity of the outer shell.

DETAILED DESCRIPTION OF THE INVENTION

Figure 1:
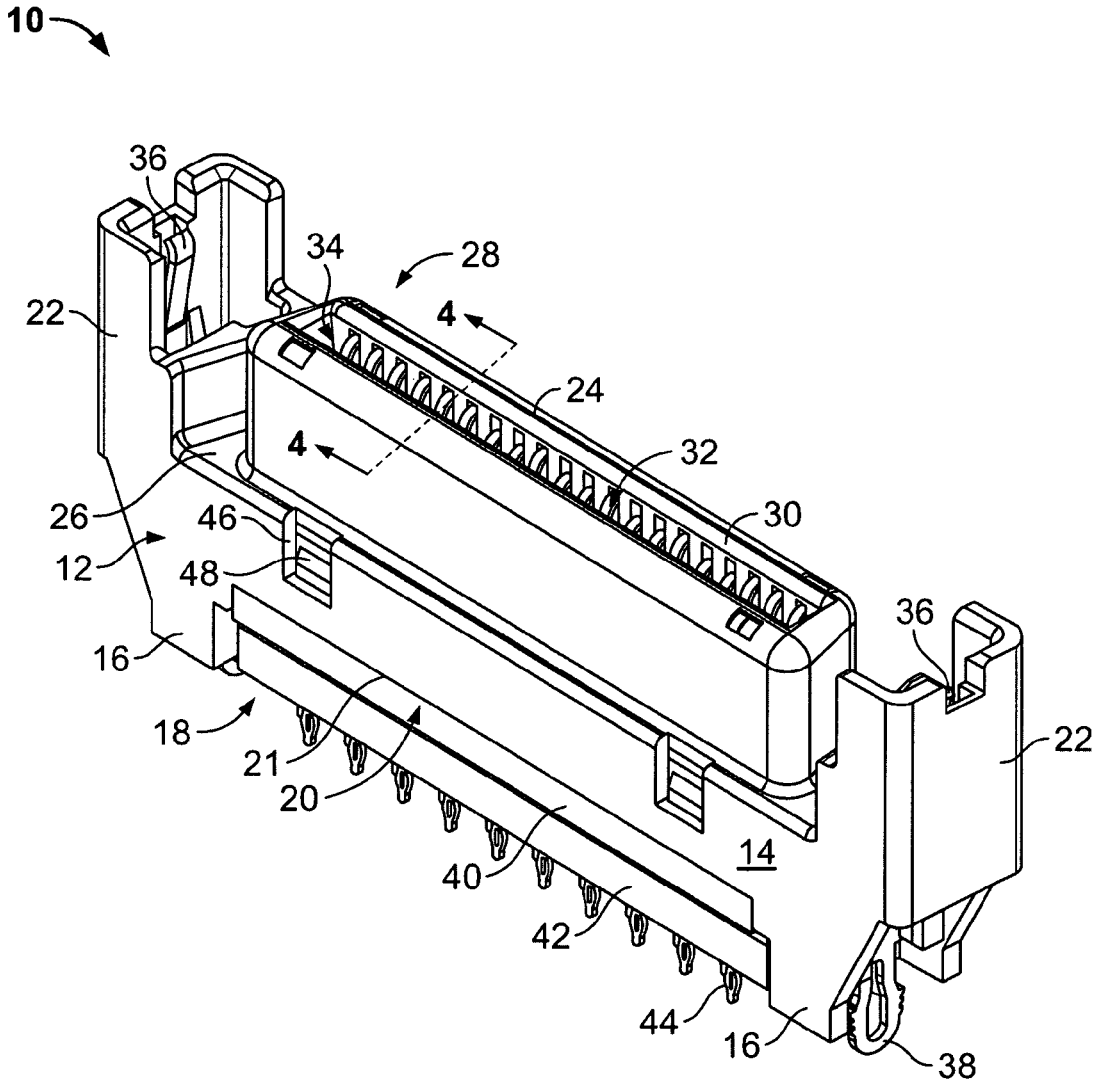
FIG. 1 illustrates a perspective view of a receptacle connector formed in accordance with an embodiment of the present invention.

FIG. 1 illustrates a receptacle connector 10 formed in accordance with an embodiment of the present invention. The receptacle connector 10 includes an outer shell 12 having a main body 14 with base posts 16 extending downward from the main body 14 toward a board-engaging end 18 of the outer shell 12. The base posts 16 are configured to rest upon a circuit board and are spaced apart from one another to define an open socket 20 there between. The open socket 20 extends between the base posts 16 along a socket border edge 21 and has an open face at the board-engaging end 18. The open socket 20 receives a pair of contact retention modules 40 (only one of which is shown in FIG. 1). The contact retention modules 40 are also referred to as "chicklets". Each contact retention module 40 is formed about a row of contacts 32. An organizer 42 is provided below the contact retention module 40 and is fit over contact tails 44 on each contact 32. The organizer 42 aligns the contact tails 44 in a desired spacing and alignment and prevents the contact tails 44 from bending when inserted into the vias within a circuit board on which the receptacle connector 10 is mounted. Optionally, the contact tails 44 may be formed as eye-of-needle pins, compliant pins, surface mount pads and the like.

The outer shell 12 includes alignment ears 22 extending upward from the main body 14 in a direction opposite to the base posts 16. The alignment ears 22 are located proximate opposite sides of the receptacle connector 10. The alignment ears 22 guide alignment with a mating plug type connector (not shown). Each alignment ear 22 has an open U-shaped cross-section that faces inward. A grounding pin 36 is held within the interior of each alignment ear 22. The grounding pins 36 are formed integral with board locks 38 that project along and downward beyond the base posts 16. The board locks 38 are securely received, in a fiction fit, within grounded openings in the circuit board. The grounding pins 36 engage corresponding grounding contacts on the mating connector to provide a grounding interface between the mating connector and the circuit board, to which the receptacle connector 10 is joined.

A D-shaped interface 24 extends upward from a ledge 26 formed on the main body 14. The D-shaped interface 24 extends toward a mating end 28 of the receptacle connector 10. The D-shaped interface 24 includes an opening 30 to an interior cavity 34, in which a plurality of contacts 32 are held. The main body 14 includes windows 46 that are configured to accept and snappable engage retention detents 48 formed on the sides of the contact retention module 42 to retain the contact retention module 40 within the socket 20 of the outer shell 12.

Figure 2:
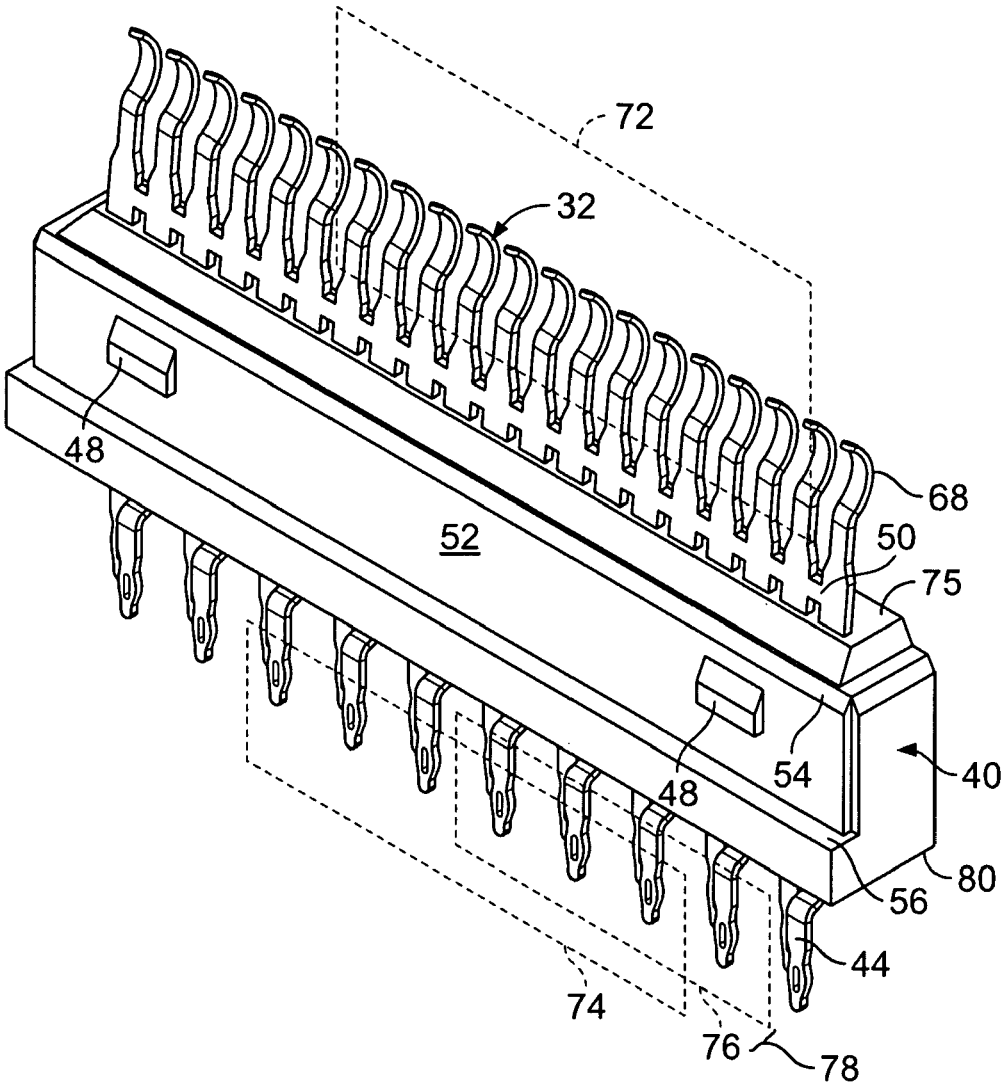
FIG. 2 illustrates a perspective view of a first side of a contact retention module retaining a plurality of contacts in accordance with an embodiment of the present invention.

FIG. 2 illustrates a perspective view of a contact retention module 40 with a row of contacts 32 embedded therein. By way of example, the contact retention module 40 may be over molded or otherwise formed over the row of contacts 32, while the contacts 32 are held in a particular alignment and spacing with respect to one another by linking tabs 50. The tabs 50 are removed after the contacts 32 are securely embedded within the contact retention module 40. The contact retention module 40 includes an outer side 52 having the retention detents 48 molded thereon. Upper and lower ledges 54 and 56 extend along the top and bottom, respectively, of the outer side 52. The upper and lower ledges 54 and 56 are configured to fit against corresponding mating features in the interior of the outer shell 12 such as the socket border edge 21 (FIG. 1) of the open socket 20 and the interior of the ledge 26, respectively.

Figure 3:
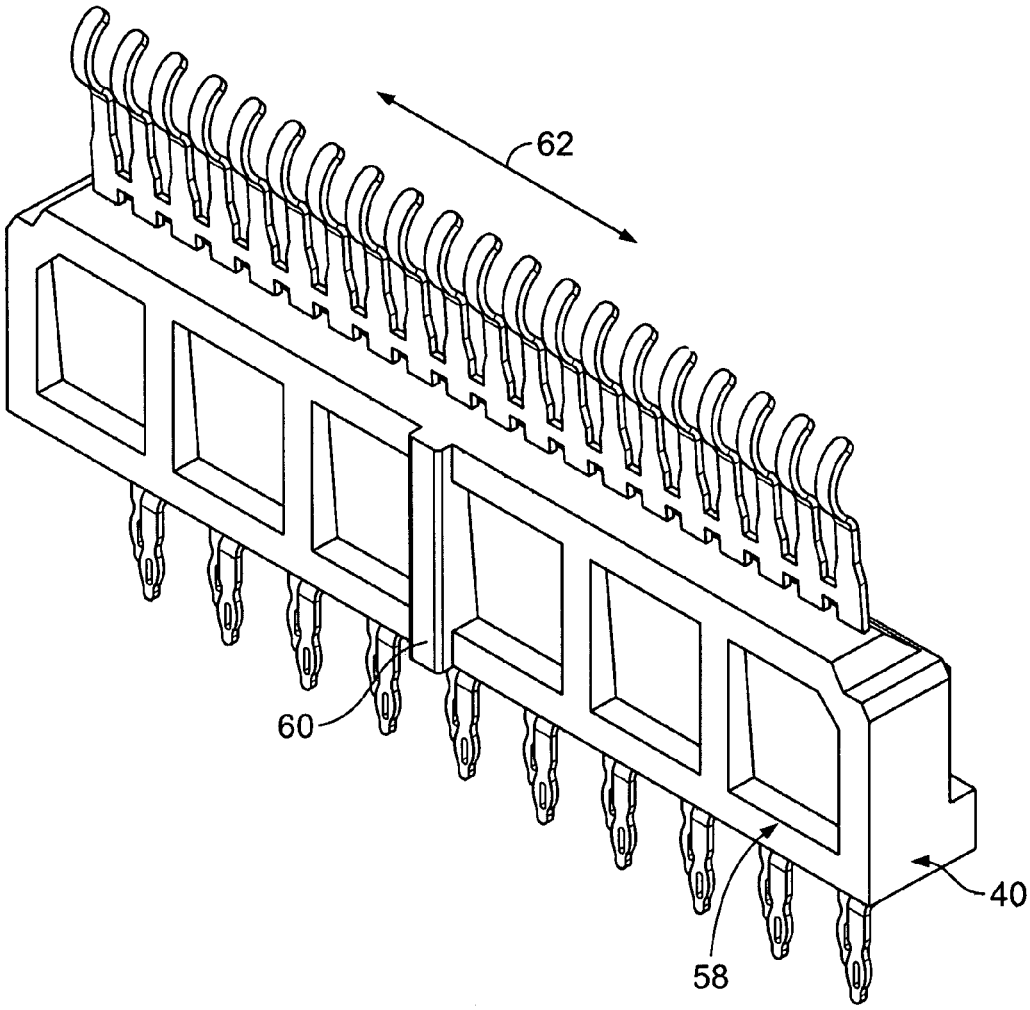
FIG. 3 illustrates a perspective view of an opposite side of the contact retention module and contacts of FIG. 2.

FIG. 3 illustrates the interior side 58 of the contact retention module 40. The interior side 58 includes a vertical rib 60 that is configured to abut against a corresponding rib 60 or similar feature on an adjoining contact retention module 40 to assist in ensuring that the pair of contact retention modules 40 are properly aligned with one another along the length of the contact retention module 40 in the directions denoted by arrow 62.

Figure 4:
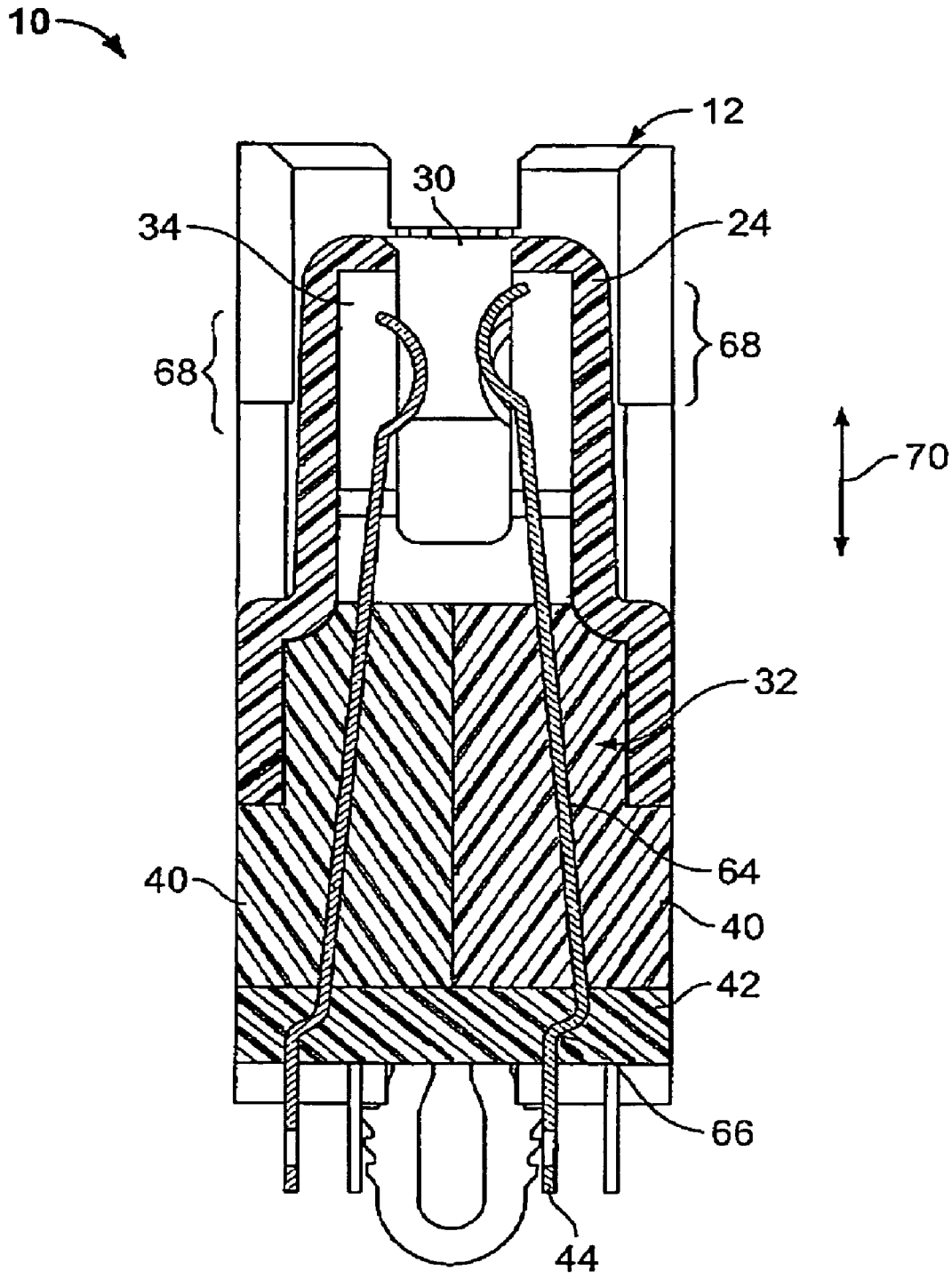
FIG. 4 illustrates a side sectional view taken along line 4—4 in FIG. 1 of the receptacle connector of FIG. 1.

FIG. 4 illustrates a cross-sectional view of the receptacle connector 10 taken along line 4—4 in FIG. 1. The outer shell 12 receives a pair of contact retention modules 40 in a side-by-side abutting manner. The organizer 42 fits over the contact tails 44 of the contacts 32 and abuts against the bottom of both contact retention modules 40. The D-shaped interface 24 surrounds the interior cavity 32 which communicates with the opening 30 through which contacts of a mating connector are inserted. Each contact 32 includes a straight main body 64 that extends along a linear axis and has one end formed integral with the contact tail 44 at an alignment bend 66. The alignment bends 66 position the contact tails 44 at a desired spacing and in a staggered footprint to align with vias in the circuit board, to which the receptacle connector 10 is joined. An end of the main body 64, opposite to the contact tails 44, is formed integral with a curved engagement portion 68.

As shown in FIG. 4, a pair of contacts 32 are arranged opposite to one another and in a facing manner with the curved engagement ends 68 within a pair of contacts 32 being offset with respect to one another in the direction of arrow 70 to form a make-first-break-last contact combination. As shown in FIG. 4, the main bodies 64 of the contacts 32 in a pair of contacts 32 are held within corresponding contact retention modules 40 in an angled manner and oriented toward one another to form a V-shape with the curved engagement portions 68 spaced closer to one another than the contact tails 44. The portion of the main body 64 embedded within the contact retention module 40 is entirely straight without any bends or curves.

Various manufacturing and assembly processes may be used to form the contact retention module 40 of an insulated material about the contacts 32, such as an over molding process and the like. The contacts 32 are embedded and sealed within the contact retention module 40 to form an air-less environment along and around the entire surface of the section of each contact 32 embedded in the contact retention module 40. The entire surface of the section of the contact 34 that is embedded within the contact retention module 40 engages, evenly and uniformly, the insulated material from which the contact retention module 40 is formed.

Returning to FIG. 2, the contact retention module 40 maintains the main bodies 64 of the row of contacts 32 within a common plane denoted by dashed lines 72 extending along the length of the contact retention module 40, such that the curved engagement portions 68 are evenly aligned with one another when extending from a top 75 of the contact retention module 40. The contact retention module 40 further maintains the contact tails 44 in a staggered footprint such that every other contact tail 44 is offset from one another along the length of the contact retention module 40. The contact tails 44 are staggered within first and second planes denoted by reference numerals 74 and 76 that are separated by a gap 78. The contact tails 44 project perpendicularly from the board facing end 80 of the contact retention module 40, while the main body 64 and curved engagement portion 68 of each contact 32 extend at an acute angle from a plane of the top 75 of the contact retention module 40.

Figure 5:
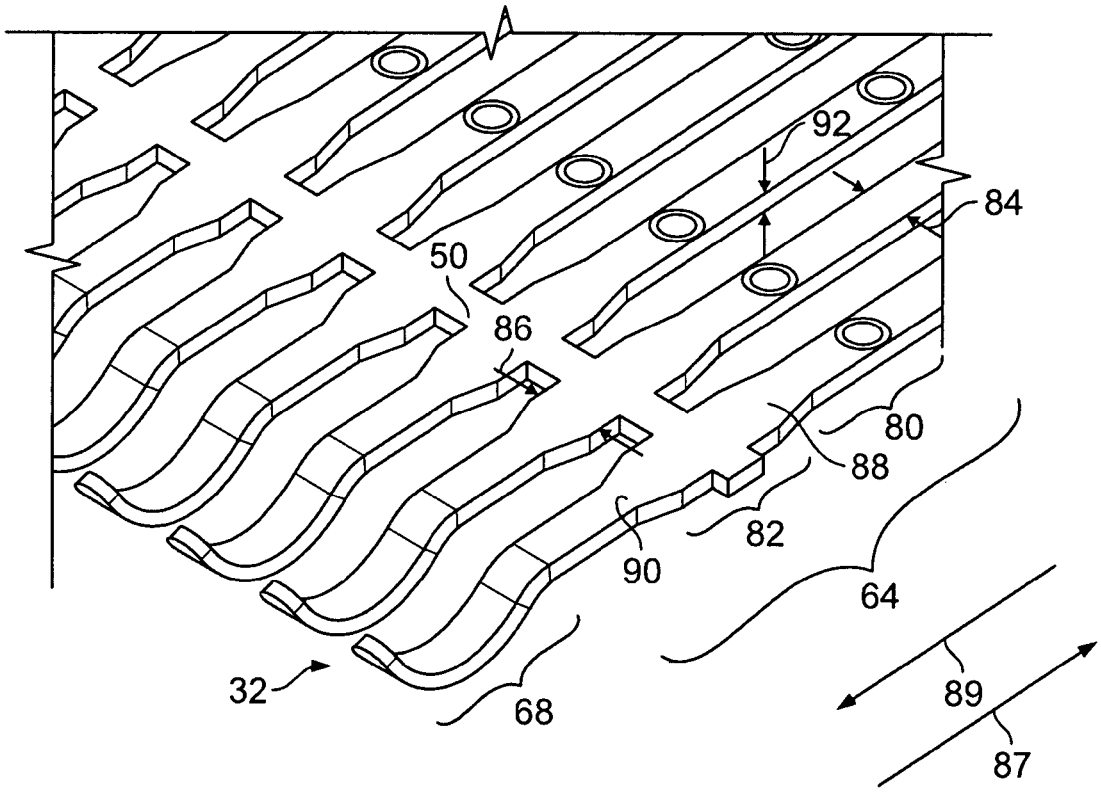
FIG. 5 illustrates a perspective view of a portion of a group of contacts held together during assembly in accordance with an embodiment of the present invention.

FIG. 5 illustrates an isometric view of a portion of a group of contacts 32 joined with one another by linking tabs 50. FIG. 5 better illustrates how the curved engagement portion 68 is formed integral with the main body 64. The main body 64 is divided into sections 80 and 82 each having a different width (denoted by arrows 84 and 86). The width 84 of the section 80 is less than the maximum width 86 of the section 82. The sections 80 and 82 join one another at a tapered transition area 88, in which the width expands from width 84 to width 86 in progression along direction 89. Section 80 has an even, constant width 84 beginning at transition area 88 and continuing along the entire length of the main body 64 in direction 87 toward the contact tail 44 (FIG. 2). The section 82 has a varying width that reaches a maximum width 86 and then reduces at transition area 90 proximate the curved engagement end 68. The contacts 32 have a constant thickness in the direction of arrows 92 along the entire length of the contacts 32.

Figure 6:
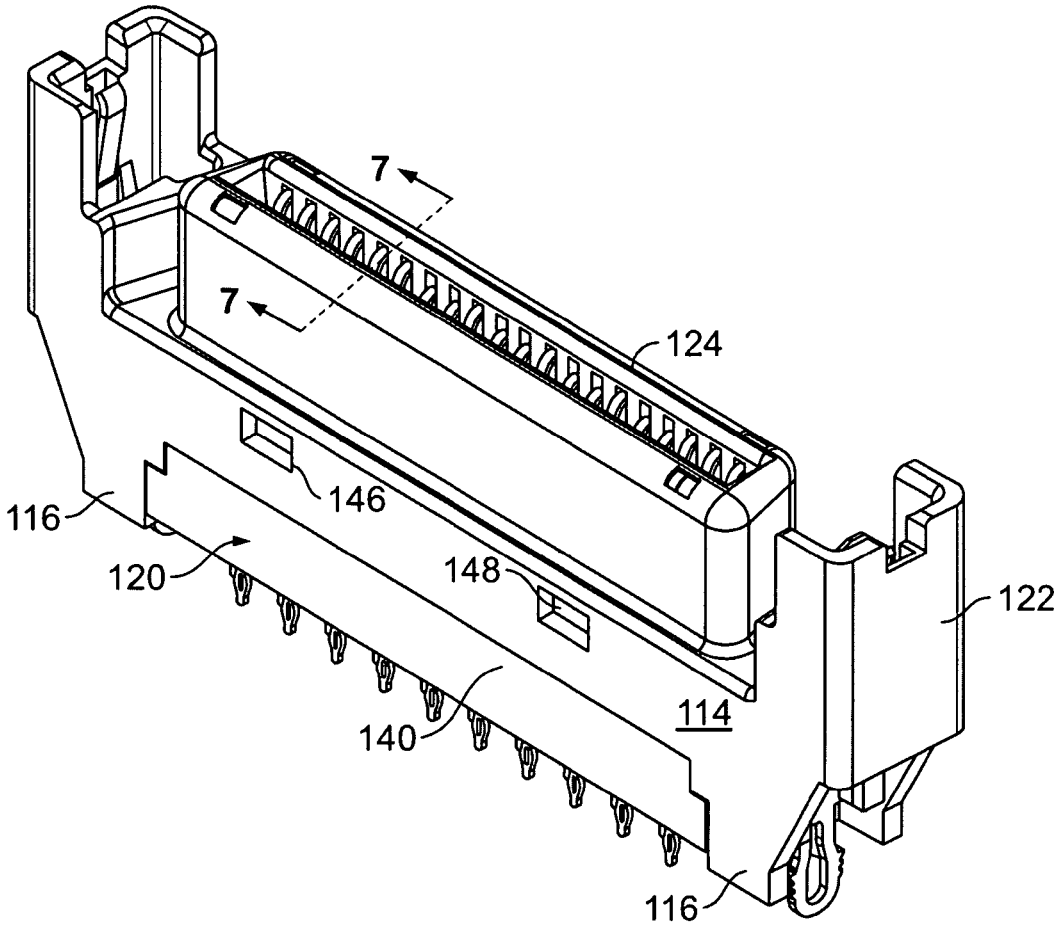
FIG. 6 illustrates a perspective view of a receptacle connector formed in accordance with an alternative embodiment of the present invention.

FIG. 6 illustrates a receptacle connector 110 formed in accordance with an embodiment of the present invention. The receptacle connector 110 resembles the receptacle connector 10 of FIG. 1 in many ways. The receptacle connector 110 includes a main body 114 joined with a D-shaped interface 124, alignment ears 122 and base posts 116. The base posts 116 are separated to form an open socket 120 therebetween. The open socket 120 receives contact retention modules 140 that are securely retained by retention detents 148 that engage windows 146 in the main body 114. Unlike the embodiment of FIG. 1, an organizer is not utilized.

Figure 7:
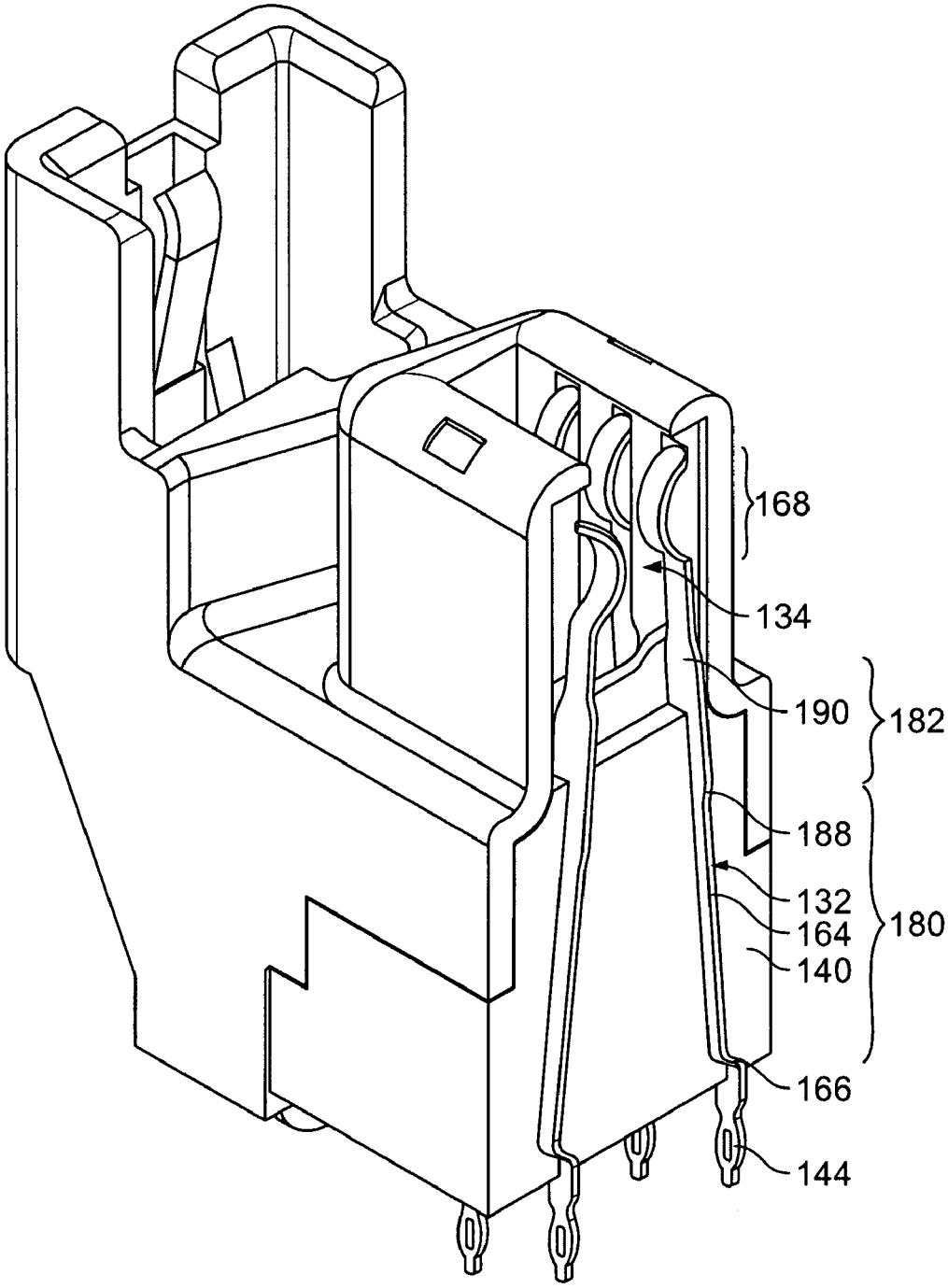
FIG. 7 illustrates a perspective view of a portion of the receptacle connector of FIG. 6 when cut along line 7—7 in FIG. 6.

FIG. 7 illustrates the contact retention modules 140 in the receptacle contact 110 of FIG. 6. The contact retention modules 140 extend downward to encompass, and are over molded about, the alignment bends 166 formed in the contact 132. The contacts 132 include straight main bodies 164 that do not bend or curve between the alignment bends 166 and the curved engagement portions 168. Each main body 164 includes sections 180 and 182. Section 180 has a constant width, while section 182 has a greater width. Transition areas 188 and 190 have tapered widths, such that the width expands when progressing from section 180 to section 182, and the width contracts when progressing from section 182 to the curved engagement portions 168. The section 180 is entirely embedded and evenly encased within the contact retention module 140, thereby exhibiting electrical properties associated with a conductor of even width and thickness embedded within a non-conductive insulator. The section 182 extends beyond the end of the contact retention module 140 into open air within interior cavity 134, and thus exhibits electrical properties associated with a conductor surrounded by air. The width at section 182 may be selected to avoid any undesirable change in impedance that might otherwise be experienced as signals propagate through the main body 164 between the curved engagement portion 168 and the contact tail 144.

In accordance with certain embodiments of the present invention, straight contacts with varying width along the length of the contact limits impedance variations within the contact and maintains a high signal to noise ratio (SNR) for signals transmitting at data rates of up to 8.5 gigabits per second. Also, the contact tails are arranged in a staggered foot-print that reduces cross talk and other forms of signal interference between adjacent contacts. The contact retention modules are over molded about the contacts, thereby enabling the contact tails to be spread apart by a desired distance on the foot print, while retaining a desired beam gap opening between the curved engagement portions of each pair of contacts.

While the invention has been described in terms of various specific embodiments, those skilled in the art will recognize that the invention can be practiced with modification within the spirit and scope of the claims.

What is claimed is:

1. An electrical connector, comprising:

first and second contacts each having a straight body portion defining, and extending along, a linear axis, said body portion having one end formed integral with a contact tail configured to be joined to a circuit board, said body portion having an opposed end formed integral with a curved engagement portion, said curved engagement portions of said first and second contacts facing one another to form a contact pair that is configured to engage a mating connector therebetween;

an outer shell having a mating end configured to be joined with the mating connector and having a board-engaging end configured to be joined to the circuit board, said outer shell having an open socket area located at said board-engaging end and having an interior cavity opening onto said mating end and onto said open socket area at said board-engaging end; and first and second contact retention modules having embedded therein said straight body portions of said first and second contacts, respectively, said first and second contact retention modules being loaded through said open socket area into said interior cavity of said outer shell with said curved engagement portions extending beyond said first and second contact retention modules into said cavity, said first and second contact retention modules holding said first and second contacts in a desired relation facing one another to form said contact pair.

2. The connector of claim 1, wherein said contact tails projects perpendicularly from said board-facing ends of said first and second contact retention modules.

3. The connector of claim 1, wherein said first and second contact retention modules are over molded about multiple contacts arranged in first and second rows along lengths of said first and second contact retention modules.

4. The connector of claim 1, wherein said first and second contact retention modules are arranged parallel to, and held against, one another within said open socket area.

5. The connector of claim 1, wherein said first and second contact retention modules retain corresponding said first and second contacts in an arrangement opposite to, and facing, one another in said cavity, said first and second contacts being staggered in a make-first-break-last arrangement.

6. The connector of claim 1, wherein said body portions of said first and second contacts extend toward one another, within corresponding said first and second contact retention modules, in a V-shaped manner.

7. The connector of claim 1, wherein said outer shell includes latch windows and said first and second contact retention modules include retention detents that engage said windows.

8. The connector of claim 1, wherein said body portions extends entirely through said first and second contact retention modules without any bends.

9. The connector of claim 1, wherein each said body portion has first and second sections with different widths, said width of said second sections being greater than said widths of said first sections, said second sections being partially over molded within said contact retention modules, said second sections being partially surrounded by air in said interior cavity of said outer shell.

10. The connector of claim 1, wherein each said body portion is divided into first and second sections along said linear axis, said first section extending through said corresponding first and second contact retention modules, said second sections projecting from said first and second contact retention modules into said interior cavity, said second sections having a width that is greater than a width of said first sections.

11. The connector of claim 1, wherein each said body portion has first and second sections with constant first and second widths, said body portions having a tapered width in a transition area between said first and second sections.

12. An electrical connector, comprising:

a contact having a straight body portion defining, and extending along, a linear axis, said body portion having one end formed integral with a contact tail and having an opposed end formed integral with a curved engagement portion, wherein said body portion is divided into first and second sections with different widths, said width of said second section being greater than said width of said first section and greater than a width of said curved engagement portion, said second section having transition areas provided at opposite ends thereof, said transition areas having tapered widths; and a contact retention module formed about said straight body portion of said contact such that said first section, one of said transition areas and a portion of said second section are embedded and sealed within said contact retention module without any surface area exposed to air, while a remaining portion of said second section, another of said transition areas and said curved engagement portion extend beyond said contact retention module and are surrounded by air.

13. The connector of claim 12, further comprising an outer shell having a mating end configured to be joined with a mating connector and having a board-engaging end configured to be joined to a circuit board, said outer shell having an interior cavity opening onto said mating end and an open socket facing said board engaging end, said contact retention module being held in said open socket.

14. The connector of claim 12, wherein said contact tail projects perpendicularly from a board-facing end of said contact retention module.

15. The connector of claim 12, wherein said contact retention module is over molded about multiple contacts arranged in a row along a length of said contact retention module.

16. The connector of claim 12, further comprising a pair of said contact retention modules arranged parallel to, and held against, one another.

17. The connector of claim 12, further comprising a pair of said contacts arranged opposite to, and facing one another, wherein said body portions of said pair of said contacts extend toward one another, within corresponding said contact retention modules, in a V-shaped manner.

* * * * *